US005433129A

United States Patent [19]

Reusch et al.

[11] Patent Number: 5,433,129

[45] Date of Patent: Jul. 18, 1995

[54] AUTOMATIC SCREW GUN FOR USE WITH A BELTED SCREW SUPPLY

[75] Inventors: Martin Reusch, Metzingen; Guenter Haas, Nuertingen; Erich Skuthan, Holzmaden, all of Germany

[73] Assignee: Karl M. Reich Maschinenfabrik GmbH, Nuertingen, Germany

[21] Appl. No.: 210,675

[22] Filed: Mar. 18, 1994

[30] Foreign Application Priority Data

Mar. 20, 1993 [DE] Germany ..... 43 08 998.4

[51] Int. Cl.[6] ..... B25B 23/06

[52] U.S. Cl. ..... 81/434; 221/136

[58] Field of Search ..... 81/434; 222/136, 120

[56] References Cited

U.S. PATENT DOCUMENTS 4,367,837 1/1983 Manino ..... 81/434 X 5,027,679 7/1991 Kawashima et al. ..... 81/434

FOREIGN PATENT DOCUMENTS 2641828 3/1978 Germany .

*Primary Examiner*—James G. Smith

*Attorney, Agent, or Firm*—W. G. Fasse; W. F. Fasse

[57] ABSTRACT

An automatic screw gun which has a guide housing for the driving blade is equipped with a deflecting member that engages the leading end of the screw supply belt to deflect the leading end of the belt out of the path of the screw being driven, including the screw head or a washer below the screw head, whereby it is prevented that portions of the belt can be clamped between the surface of a work piece and the screw head or washer. A spring biases the deflector member into a rest position and the advancing belt brings the deflector member into a working position in which it holds the leading end of the belt out of the way.

9 Claims, 3 Drawing Sheets

AUTOMATIC SCREW GUN FOR USE WITH A BELTED SCREW SUPPLY

FIELD OF THE INVENTION

The invention relates to an automatic screw gun for use with a belted screw supply, wherein a screw belt carrying the screws is advanced through a belt guide channel.

BACKGROUND INFORMATION

German Patent Publication (DE-OS) 2,641,828 (Mueller et al.), published on Mar. 23, 1978, describes an automatic screw gun capable of driving screws that are supplied to the gun by a belted screw supply. The screw gun with its magazine in which the belted screw supply is held, are portable. The belted screw supply comprises a belt with a belt backing to which belt loops are secured. Each belt loop holds one screw. More specifically, the belt loop extends around the screw shaft.

A belt feed advance mechanism feeds the screw carrying belt stepwise so as to bring the lead screw into axial alignment with the screw driver blade. As the screw feed advance progresses, the screw holding loop is torn open, whereby portions of the belt and/or of the loop may get lodged between the screw head and the work piece. The result is undesirable, especially where fine or easily marred work piece surfaces are involved.

OBJECTS OF THE INVENTION

In view of the foregoing it is the aim of the invention to achieve the following objects singly or in combination:

- to improve an automatic screw gun in such a way that the leading end of the screw supply belt, including its torn open loop, is cleanly separated from the screw that is currently being driven so that any residues of the supply belt and loop cannot be caught between the screw head and the surface of the work piece;
- to make sure that the supply belt does not hinder the driving, especially the straight driving of the screw; and
- to make sure that portions torn off from the supply belt can easily escape out of the way of the screw being driven.

SUMMARY OF THE INVENTION

A screw gun according to the invention comprises a guide channel for the screw supply belt in which a movably mounted belt lifter is so positioned that it deflects and lifts off the advancing belt away from the screw. Preferably, the belt lifter or deflector is so positioned that it cooperates with the leading or free end of the supply belt.

The present belt lifter or deflector is so positioned and constructed that it assures a complete separation of the supply belt from the screw being currently driven. Thus, it is assured that the screw can be driven without any hindrance and without the entrainment of any portions of the supply belt. As a result, wedging of belt portions between the screw head and the work piece surface are prevented.

It is a special advantage of the invention that even screws with a large diameter head or screws provided with a sealing washer below the head can be properly driven, because the belt lifter or deflector moves sufficiently far out of the range of the washer or screw head, so that their movement is not hindered by any belt portions, thereby assuring a trouble-free and straight driving of the screws.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

Figure 1:
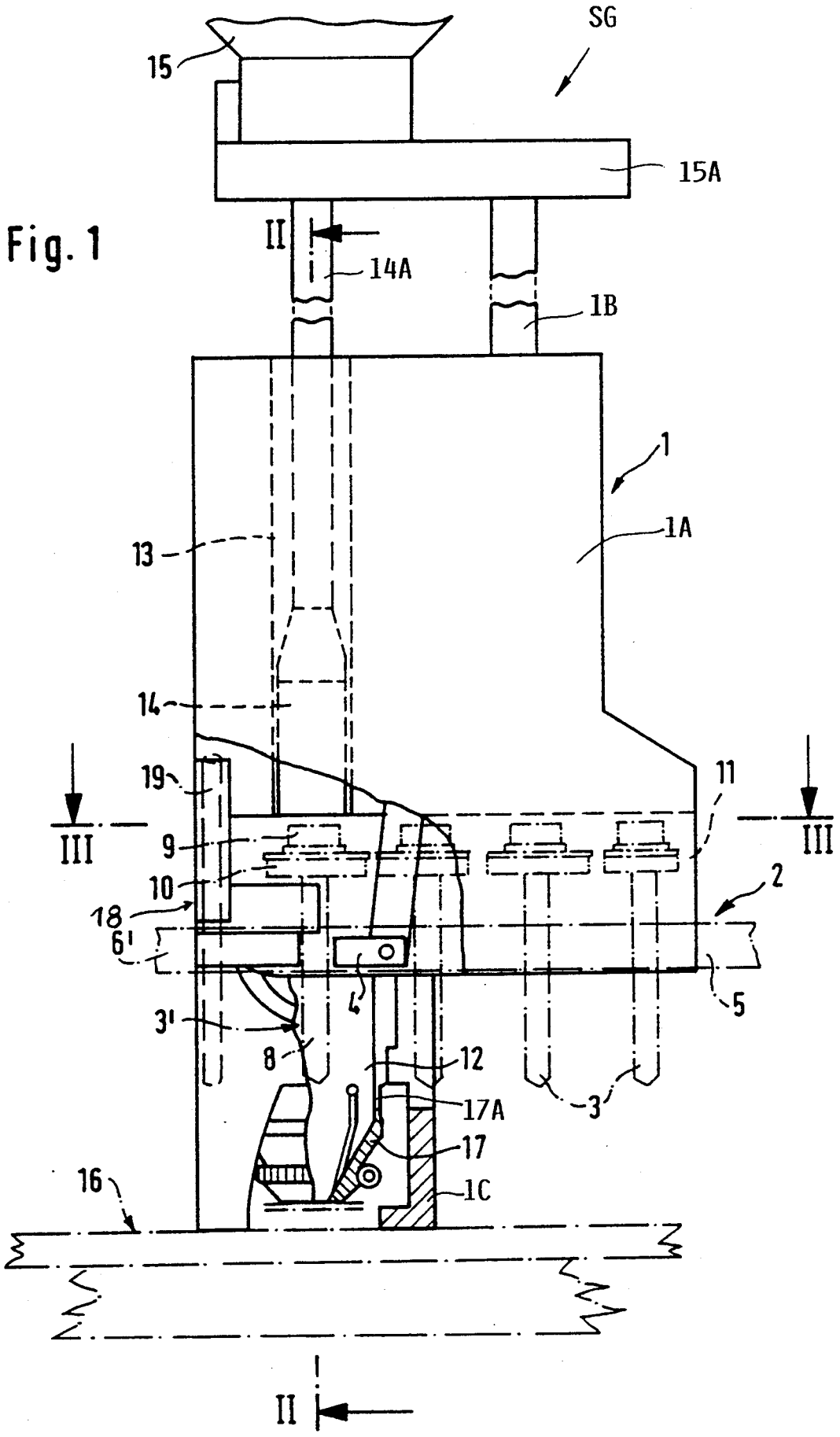
FIG. 1 is a side view, partially in section, of the driving head of an automatic screw gun according to the invention.

FIG. 1 shows the driving head 1 of a screw gun SG having a driving electrical motor 15 mounted on a support 15A that is movable relative to a guide housing 1A. A screw driving blade 14 is connected with its shaft 14A to the motor 15. The guide housing 1A is connected to the support 15A by at least one guide bar 1B. The guide housing 1A has two guide channels. One guide channel 13 guides the driving blade 14. The other guide channel 11 guides a screw carrying belt 5 forming a belted screw supply 2 passing through the guide channel 11 driven by a feed supply mechanism 4. The belt 5 has a belt backing 6 and belt loops 7 holding individual screws 3, the shafts of which pass through the loops 7. A lead screw 3' is axially aligned with the drive blade 14 for driving the screw into a work piece 16. For this purpose, a foot 1C of the guide housing 1A rests against the surface of the work piece 16 and the motor 15 with its support 15A is pressed downwardly guided by the guide housing 1A and the guide bar or bars 1B slidingly received in the guide housing 1A. The backing 6 of the belt 5 carries loops 7 and is made of synthetic plastic material. The screws 3, 3' have a head 9 and may carry a sealing washer 10 that may have a diameter substantially larger than the diameter of the screw shaft 8.

The guide channel 11 for the screw belt 5 with the screws 3, 3' merges into a lower guide bore 12 that in turn merges into the supporting and guiding channel 13. The arrangement is such, that the lead screw 3' is always axially aligned with the drive blade 14 and with a centering funnel 17 provided centrally in the foot 1C of the guide housing 1A. Preferably, the guide funnel 17 is elastically secured in the foot 1C, for example, by reduced thickness funnel sections 17A. Thus, the funnel can yield to avoid damage in case the belt carries a misaligned screw.

Figure 2:
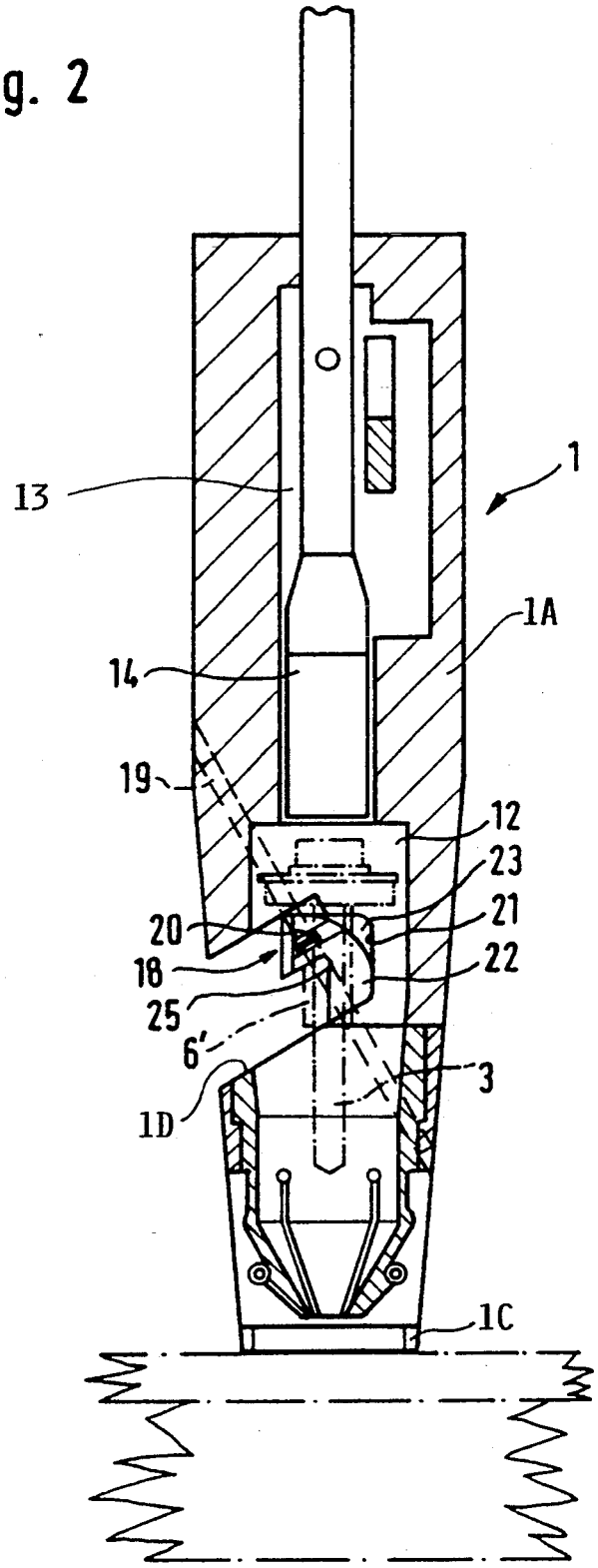
FIG. 2 is a sectional view along section line II—II in FIG. 1.
Figure 3:
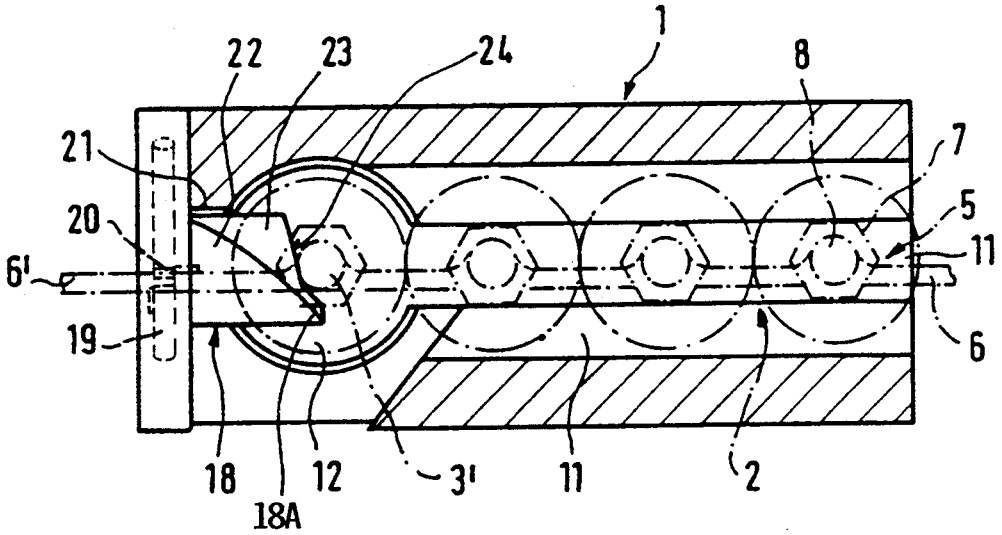
FIG. 3 is a sectional view along section line III—III in FIG. 1, illustrating the belt lifter and deflector in its rest position.

Referring to FIGS. 2 and 3, a belt lifting and deflecting member 18 according to the invention is tiltably mounted on a journal shaft 19 which in turn is mounted at a slant in the guide housing 1A. The slant of the journal shaft 19 extends across the guide bore 120 A biasing spring 20 tends to urge the belt lifter and deflecting member 18 into the rest position shown in FIG. 3, whereby the member 18 rests against a stop surface 21 of the guide housing 1A.

The belt lifter and deflecting member 18 comprises substantially an angular section having a leg 22 that bears against the free end 6' of the belt backing 6 of the supply belt 5. The leg 22 of the member 18 has a curved contact surface 23 facing toward the guide channel 11. Additionally, the member 18 has a centering surface 24 which is part of a prismatic portion of the member 18 and extends in parallel to the guide channel or bore 12. The surfaces 23 and 24 merge into a deflecting tip 18A which deflects the leading end 6' of the belt backing 6 into the belt exit or discharge opening 1D when the deflector 18 is brought into the operative position shown in FIG. 4 by the feed advance of the belt 5.

The operation of the lifter and deflector member 18 will now be described with particular reference to FIGS. 1 and 3 which show the member 18 in its rest position. Once the electric motor 15 has been switched on, the driving blade 14 rotates and by pressing the motor downwardly after the foot 1C has been placed in contact with the work piece 16, the rotating blade 14 moves downwardly, whereby the engagement of the belt loop 7 with the threading on the screw shaft 8 causes the loop 7 to move upwardly in a direction opposite to the feed advance direction of the screw 3'. A stop surface 25 of the member 18 thereby engages the leading end 6' of the belt 5 to prevent the further rise of the belt, whereby the loop 7 is torn open to release the lead screw 3' from the belt 5.

Figure 4:
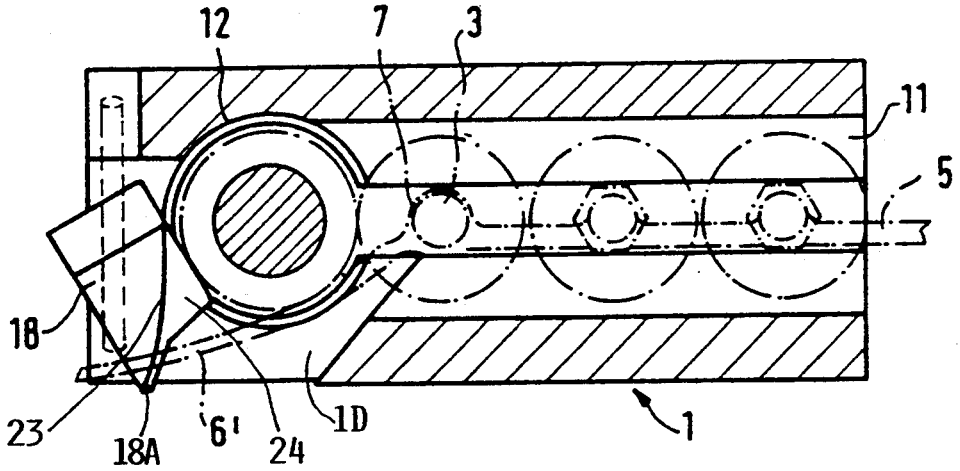
FIG. 4 is a sectional view similar to that of FIG. 3, but showing the belt lifter and deflector in its belt deflecting position.

The screw head or, if provided the sealing washer 10 now contacts the surface 23 of the member 18, thereby tilting the member 18 clockwise around its journal shaft 19 into the operative position shown in FIG. 4. In this position the leg 22 of the member 18 entrains the free end 6' of the belt backing 6, thereby deflecting the leading end away from the screw driving range of the screw 3' into the discharge opening 1D so that the lead screw 3' can travel without any hindrance into and through the centering funnel 17 that guides the screw toward and into the surface of the work piece 16 into which the blade drives the screw.

As the screw keeps advancing into the work piece, the belt feeder 4 is cocked so that after the return of the screw blade 14 into the starting or rest position, the member 18 under the force of its biasing spring 20 is also returned into its rest position and the belt 5 with its screw supply 2 is advanced one step in the direction toward the guide bore 12 sufficiently to axially align the next screw with the longitudinal axis of the blade 14, whereby the shaft 8 again is contacted by the centering surface 24 of the lifting and deflecting member 18.

Although the invention has been described with reference to specific example embodiments, it will be appreciated that it is intended to cover all modifications and equivalents within the scope of the appended claims.

What we claim is:

1. An automatic screw gun for use with a screw supply belt, comprising a guide housing, a driver blade rotatably and slidably mounted in said guide housing, a belt guide channel extending in said guide housing for guiding said screw supply belt toward said driver blade, a belt drive mechanism for feeding said screw supply belt through said belt guide channel to bring a lead screw held by said belt into axial alignment with said driver blade, a belt deflector (18) movably mounted in said belt guide channel (11) for deflecting said belt away from said lead screw (3'), wherein said belt deflector is so positioned in said belt guide channel next to said lead screw that a leading end (6') of said screw supply belt engages said belt deflector (18) for moving said belt deflector from a rest position into an operative position.

2. The automatic screw gun of claim 1, wherein said belt deflector has a screw contact surface so positioned that an axial screw movement drives said belt deflector into a belt deflecting position.

3. The automatic screw gun of claim 1, further comprising a journal shaft (19) on which said belt deflector (18) is mounted for a tilting movement between a rest position and a belt deflecting position and back again.

4. The automatic screw gun of claim 3, wherein said journal shaft (19) is mounted at a slant relative to a longitudinal axis of said driver blade (14).

5. The automatic screw gun of claim 1, wherein said belt deflector (18) comprises a slanted contact surface (23) facing toward said driver blade (14), said contact surface (23) engaging a portion of said screw being driven into a work piece for deflecting said belt.

6. The automatic screw gun of claim 1, wherein said belt deflector comprises a centering surface (24) facing said belt guide channel (11) and extending parallel to said driver blade for centering said lead screw at least at the beginning of a driving motion of said lead screw.

7. The automatic screw gun of claim 1, wherein said screw has a head section (9, 10) having a diameter substantially larger than a screw shaft diameter for moving said belt deflector into an operative belt deflecting position.

8. The automatic screw gun of claim 5, wherein said contact surface (23) is curved with a convex configuration facing toward said screw for cooperation with said screw to tilt said belt deflector into an operative position.

9. The automatic screw gun of claim 1, further comprising a biasing spring (20) positioned in said guide housing in contact with said belt deflector for normally biasing said belt deflector into a rest position.

* * * * *